US005927032A

United States Patent [19]

Record

[11] Patent Number: 5,927,032

[45] Date of Patent: Jul. 27, 1999

[54] INSULATED BUILDING PANEL WITH A UNITARY SHEAR RESISTANCE CONNECTOR ARRAY

[76] Inventor: Grant C. Record, Suite 302, 416 River Ave., Williamsport, Pa. 17701

[21] Appl. No.: 08/846,002

[22] Filed: Apr. 25, 1997

[51] Int. Cl.[6] ..... E04C 1/10

[52] U.S. Cl. ..... 52/309.11; 52/309.9; 52/309.12; 52/309.14; 52/309.17; 52/309.15; 52/284; 52/405.1; 52/412

[58] Field of Search ..... 52/309.4, 309.8, 52/309.9, 309.11, 309.12, 310.14, 309.15, 309.17, 284, 405.1, 412, 783.1, 783.11, 590.2, 592.1, 783.17, 753.17, 794.1

[56] References Cited

U.S. PATENT DOCUMENTS

| | | | |
|---|---|---|---|
| 2,280,647 | 4/1942 | Hawes . | |
| 2,448,186 | 8/1948 | Miller et al. . | |
| 3,145,502 | 8/1964 | Rubenstein . | |
| 3,197,932 | 8/1965 | Nida . | |
| 3,331,174 | 7/1967 | Wesch et al. | 52/309 |
| 3,479,784 | 11/1969 | Massagli | 52/588 |
| 3,550,338 | 12/1970 | Satkin et al. . | |
| 3,560,285 | 2/1971 | Schroter et al. . | |
| 3,583,123 | 6/1971 | Holmgren | 52/584 |
| 3,676,279 | 7/1972 | Beaver . | |
| 3,715,846 | 2/1973 | Sullhofer | 52/309 |
| 3,725,185 | 4/1973 | Curtis . | |
| 3,786,607 | 1/1974 | Bartels . | |
| 3,826,051 | 7/1974 | Miller et al. . | |
| 3,871,153 | 3/1975 | Birum, Jr. . | |
| 3,885,363 | 5/1975 | Whittey . | |
| 3,886,706 | 6/1975 | Baker . | |
| 3,979,217 | 9/1976 | Sutton . | |
| 4,120,123 | 10/1978 | Knudson | 52/86 |
| 4,123,879 | 11/1978 | Blodee et al. . | |
| 4,130,973 | 12/1978 | Gustavsson . | |
| 4,132,043 | 1/1979 | Juba . | |
| 4,263,765 | 4/1981 | Maloney . | |
| 4,292,364 | 9/1981 | Wesch et al. . | |
| 4,304,080 | 12/1981 | Freeman . | |
| 4,306,395 | 12/1981 | Carpenter . | |
| 4,449,336 | 5/1984 | Kelly . | |
| 4,567,705 | 2/1986 | Carlson . | |
| 4,614,071 | 9/1986 | Sams e al. . | |

(List continued on next page.)

FOREIGN PATENT DOCUMENTS

| | | |
|---|---|---|
| 0 068 742 | 1/1983 | European Pat. Off. . |
| 764197 | 5/1934 | France . |
| 2228918 | 12/1974 | France . |
| 2 549 511 | 1/1985 | France . |
| 2 654 095 | 5/1991 | France . |
| 1 135 815 | 7/1958 | Germany . |
| 598607 | 3/1948 | United Kingdom . |
| 762464 | 11/1956 | United Kingdom . |
| WO 93/20020 | 10/1993 | WIPO . |

*Primary Examiner*—Christopher Todd Kent
*Assistant Examiner*—Yvonne Horton Richardson
*Attorney, Agent, or Firm*—Seed and Berry LLP

[57] ABSTRACT

An insulated structural building component, such as a building panel, having front and back face sheets and interconnected joining sides to define an interior area of the building component. An insulating core having one or more throughholes extending at least partially therethrough is positioned within the interior area. A unitary shear resistance connector array is positioned between the front and back face sheets and includes a web portion and one or more shear resistance connectors projecting away from the web and into the one or more throughholes. The shear resistance connector array in one embodiment being an integral portion to a thin outer skin surrounding the insulative core, with one or both front and back face sheets being connected to the outer skin.

12 Claims, 7 Drawing Sheets

U.S. PATENT DOCUMENTS

| | | | |
|---|---|---|---|
| 4,628,653 | 12/1986 | Nash . | |
| 4,633,634 | 1/1987 | Nemmer et al. . | |
| 4,674,253 | 6/1987 | Young . | |
| 4,712,349 | 12/1987 | Riley et al. . | |
| 4,712,352 | 12/1987 | Low . | |
| 4,774,794 | 10/1988 | Grieb . | |
| 4,841,702 | 6/1989 | Huettemann . | |
| 4,942,702 | 7/1990 | Lemasson . | |
| 5,034,085 | 7/1991 | Brauchl . | |
| 5,138,773 | 8/1992 | Goodwin et al. . | |
| 5,168,674 | 12/1992 | Molthen . | |
| 5,245,810 | 9/1993 | Foss . | |
| 5,274,979 | 1/1994 | Tsai . | |
| 5,279,089 | 1/1994 | Gulur . | |
| 5,373,678 | 12/1994 | Hesser . | |
| 5,440,846 | 8/1995 | Record . | |
| 5,612,111 | 3/1997 | Lin | 428/71 |
| 5,673,524 | 10/1997 | Gailey | 52/309.9 |

INSULATED BUILDING PANEL WITH A UNITARY SHEAR RESISTANCE CONNECTOR ARRAY

TECHNICAL FIELD

The present invention is directed toward building components used for building construction and, more particularly, toward a premanufactured, composite building panel or other composite building components that exhibit improved strength, weight, and size characteristics.

BACKGROUND OF THE INVENTION

Recent changes in today's housing industry have led to an increased use by builders of premanufactured or fabricated construction components. Premanufactured building components, such as panels, are used for walls, roofs, floors, doors, and other components of a building. Premanufactured building components are desirable because they decrease greatly the time and expense involved in constructing new building structures. However, the premanufactured building components must comply with a number of required specifications based on structural criteria, such as axial load-bearing, shear and racking strengths, and total weight of the components. Additional criteria that may affect the specifications of the components include fire resistance, thermal efficiency, acoustical rating, rot and insect resistance, and water resistance. In addition, the preferred premanufactured components are readily transportable, efficiently packaged, and easily handled.

Premanufactured components for building construction have in the past had a variety of constructions. A common component is a laminated or composite panel. One such composite panel includes a core material of foam or other insulating material positioned between wood members, and the combination is fixed together by nails, screws, or adhesives. These wood composite panels suffer from the disadvantage of being combustible and not mechanically stable enough for some construction applications. These wood composite panels are inadequate sound barriers and are subject to rot, decay, and insect attack. Accordingly, wood composite panels are not deemed satisfactory in many modern building applications. In a variation of the wood-composite building panel, a laminated skin is fixed to the outside wood members. These panels with the laminated skin are more expensive to manufacture while suffering from the same inadequacies of the panels without the laminated skin.

A significant improvement to the building component technology was developed and set forth in my U.S. Pat. No. 5,440,846, which is hereby incorporated by reference in its entirety. The improved technology provides a structural building component, having front and back side panels positioned opposite each other, and a plurality of joining sides positioned intermediate the front and back side panels so as to substantially define a six-sided structure having an interior area therein. An insulating core is positioned in the interior area, and the insulating core has a plurality of throughholes extending between the front and back side panels. A plurality of individual shear resistance connectors are positioned in the throughholes and adhered to the front and back side panels.

Constructing the building component using the shear resistance connectors substantially increases the shear strength of the component. As a result, improved building components can be constructed to vary the load-bearing strength vs. weight characteristics of the building components by varying the thicknesses, densities and configurations of the side panels and the joining sides, and by varying the number and positioning of the shear resistance connectors. Accordingly, a person can design a building structure, determine the structural requirements for the building components, and then select a desired load-bearing strength, shear strength, and weight of the building panels to meet the structural requirements, and then construct the appropriate specified panel required for the defined application.

The improved building components with shear resistance connectors can be very strong, lightweight, and versatile building components, compared to similar panels without the shear resistance connectors. However, the manufacturing of such building components can be a relatively time-consuming and labor-intensive process, which can increase cost and lower availability of the components.

SUMMARY OF THE INVENTION

The present invention is directed toward a structural building component that overcomes drawbacks experienced by other building components and that is easier and less expensive to manufacture. In one embodiment of the present invention, the structural building component has front and back side portions that are constructed of a first material and that are positioned opposite each other. One or more interconnected joinery members are intermediate the front and back side portions to define an interior area of the building component. An insulating core constructed of a second material different from the first material is within the interior area for improving the insulating properties and reducing the weight of the building component. The insulating core has opposing first and second sides, with the first side being adjacent to the front side portion and the second side adjacent to the back side portion. The insulating core has one or more throughholes extending at least partially between the first and second side portions.

A shear resistance connector array having a web portion and one or more shear resistance connectors attached to the web portion is connected to one of the front and back side portions. The shear resistance connector is integral to and projects away from the web portion and into the throughhole. The shear resistance connector defines an inside area that, in one embodiment, is filled with a selected material having lessor or greater density than the first material.

In an embodiment of the invention, the shear resistance connector array is a unitary member defining a plurality of shear resistance connectors and a web portion integrally connected to and spanning between the shear resistance connectors. The integrally formed shear resistance connectors are hollow with an inside area extending between a closed end of the shear resistance connector spaced apart from the web portion and an open end substantially coplanar with the web portion. The web portion of the shear resistance connector array further includes one or more apertures intermediate the shear resistance connectors, and a portion of the insulating core extends through the apertures and is adjacent to the back side portion of the building component.

In an alternate embodiment of the invention, the building panel has an insulative core substantially encased by an outer skin portion defined by front and back sections. The shear connector array is integrally connected to the front or back sections and the shear resistance connectors extend at least partially into the interior area toward the other of the front or back sections. The web portion of the shear connector array is an integral portion of the front or back section and the shear resistance connectors project away from the web portion. The front and back sections are adapted to receive a face sheet thereon, such that the respective front or back section is between the face sheet and the insulating core.

In another embodiment, the shear connector array is connected to the outer skin's front section with the shear resistance connectors extending toward the outer skin's back section and terminating at a position intermediate the front and back sections. The back section also has a shear resistance connector connected thereto that extends toward the front section. Each of these front and back sections are adapted to receive a face sheet thereon.

DETAILED DESCRIPTION OF THE INVENTION

Figure 1:
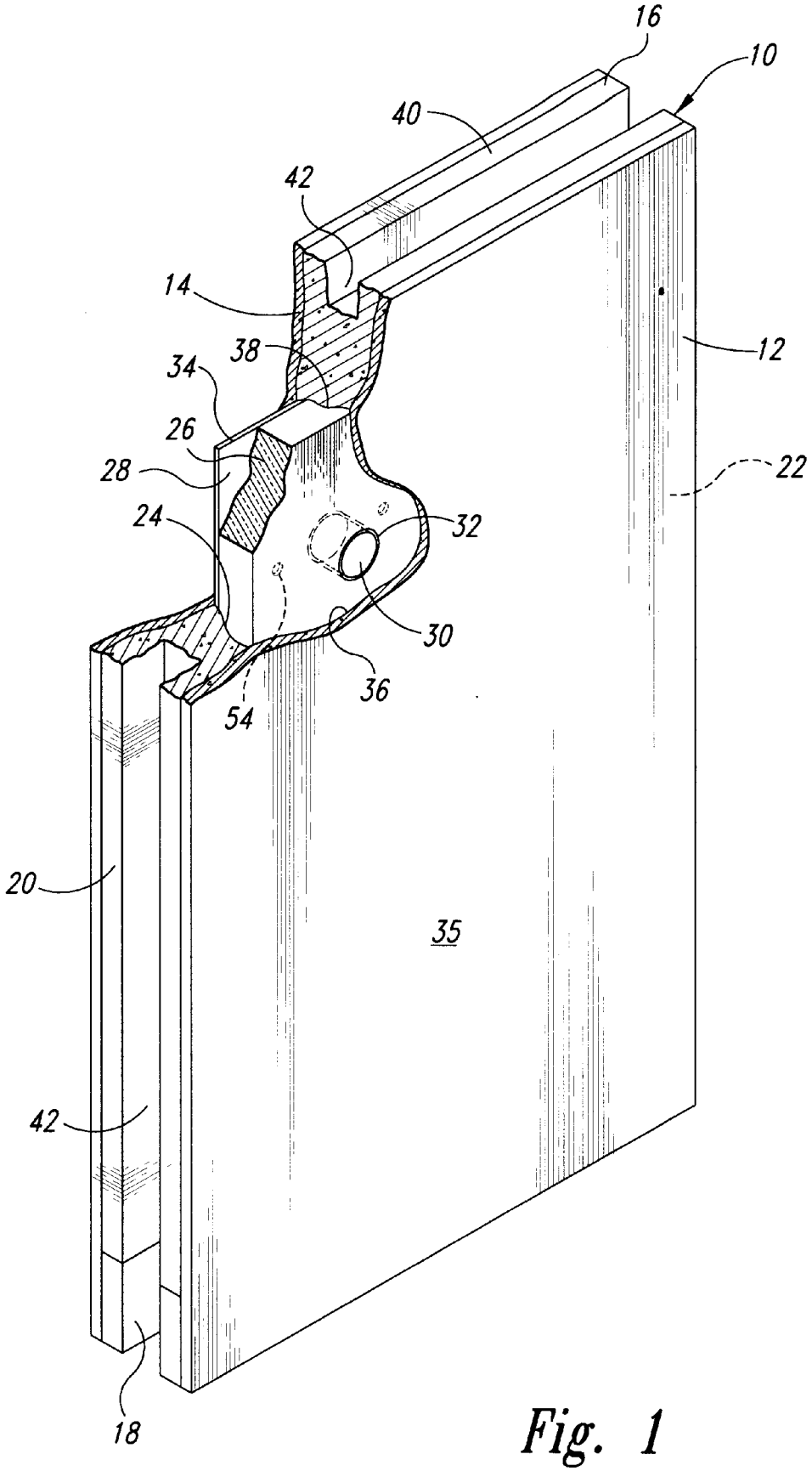
FIG. 1 is an isometric view of a building panel in accordance with an embodiment of the present invention, and a corner of the panel being illustrated partially cut away showing an insulating core and a shear resistance connector array within the building panel.

The present invention will be more clearly understood from the following detailed description of illustrative embodiments taken in conjunction with the attached drawings. A building panel 10 in accordance with embodiments of the present invention is shown in the drawings for illustrative purposes.

Figure 2:
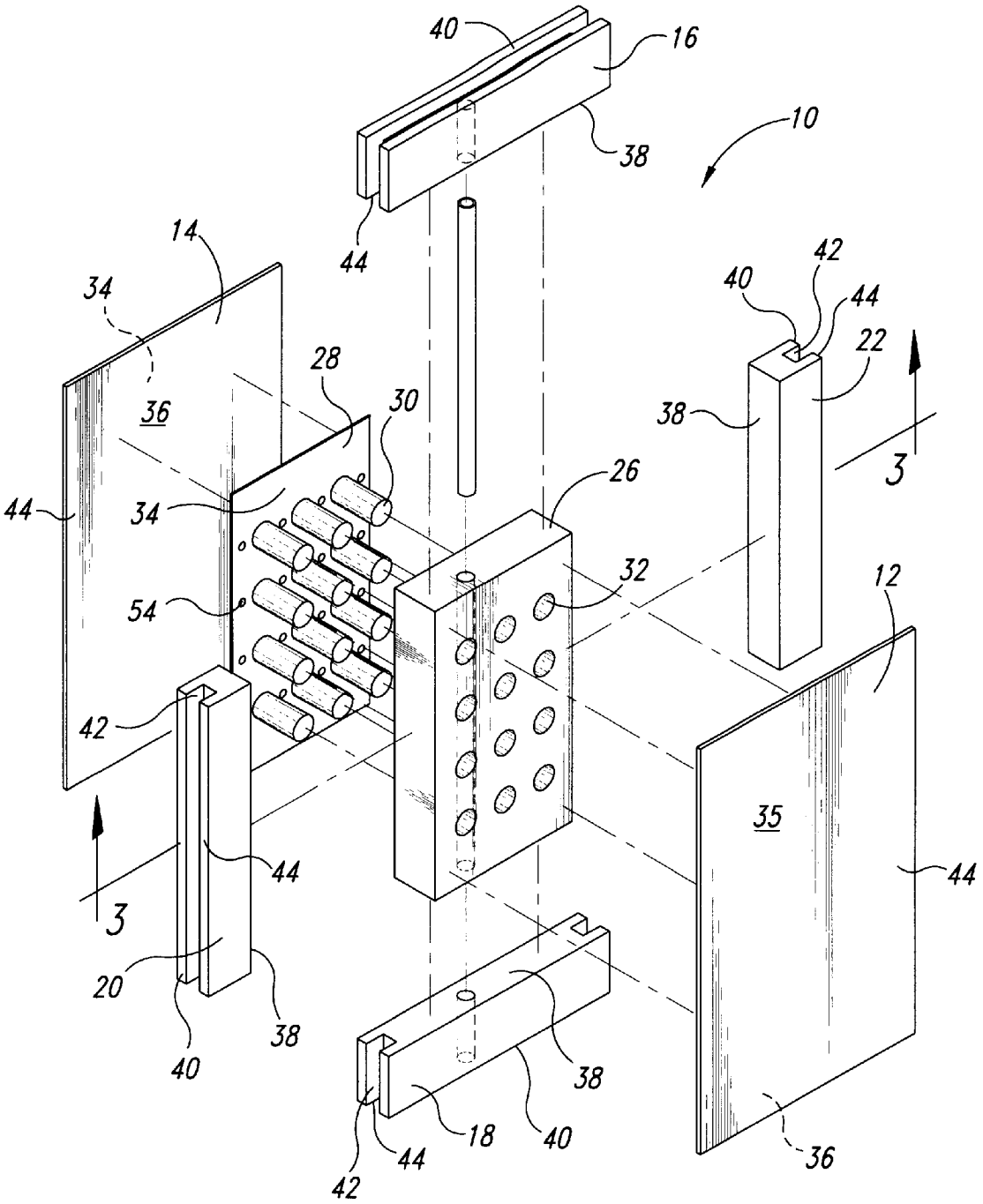
FIG. 2 is a reduced, schematic exploded view of the building panel illustrated in FIG. 1.

As best seen in FIGS. 1 and 2, the building panel 10 of a first embodiment includes a front face sheet 12 that defines a forward side of the panel and a back face sheet 14 opposite the front face sheet and spaced apart therefrom to define a back side of the panel. The front and back face sheets 12 and 14 are separated by a top joining side 16 and a bottom joining side 18 that are intermediate and at opposite ends of the face sheets. A left joining side 20 and a right joining side 22 are also intermediate the front and back face sheets 12 and 14 and extend between the top and bottom joining sides 16 and 18 at opposite edges of the face sheets. Accordingly, the front and back face sheets 12 and 14 and the joining sides 16, 18, 20, and 22 are interconnected to form a six-sided box-like structure having an interior chamber 24 therein.

A shear resistance connector array 28 having a sheet-like web 34 and shear resistance connectors 30 projecting from the web is positioned in the interior chamber 24. The web 34 is adjacent to the back face sheet 14 and the shear resistance connectors 30 project toward the back face sheet 14. An insulating core 26 is positioned in the interior chamber 24 and in engagement with the shear resistance connector array 28. The insulating core 26 has a plurality of throughholes 32 therein, and the shear resistance connectors 30 extend from the web 34, into the throughholes, and connect to the front face sheet 12.

The shear resistance connector array 28 is rigidly connected to the insulating core 26, the front face sheet 12, and the back face sheet 14 so as to provide increased shear force resistance strength and load bearing strength of the building panel 10. The shear resistance connector array 28 keeps the front and back face sheets 12 and 14 flat and very stiff such that, when the building panel 10 defines a portion of a building and wind loads, seismic loads, or other loads are exerted on the building, the face sheets distribute the loads over the entire building panel 10 and avoid concentrated point loads on the panel. Accordingly, the front and back face sheets 12 and 14, the joining sides 16, 18, 20, and 22, the shear resistance connector array 28, and the insulating core 26 are interconnected to provide a load-bearing, insulating building panel that greatly increases the shear force resistance strength and thermal efficiency of a panelized building structure constructed from the panels.

As best seen in FIGS. 1 and 2, the front and back face sheets 12 and 14 are stress-skin members each having an exterior surface 35 that faces away from the opposing face sheet and an interior surface 36 that communicates with the interior chamber 24. In the preferred embodiment of the invention, the front and back face sheets 12 and 14 are composite stress-skin sheets constructed of multiple layers of lightweight magnesium oxide-based mineral compound. The multiple layers are smoothly blended together and cured so as to prevent definitive layer intersection lines between adjacent layers. The front and back face sheets 12 and 14 each have three or more layers of the magnesium oxide-based mineral compound, and each layer includes a selected additive to provide the respective layer with predetermined characteristics. As an example, the innermost layer includes an additive having improved fire-resistance and the outermost layer includes an additive having improved bonding characteristics.

Figure 3:
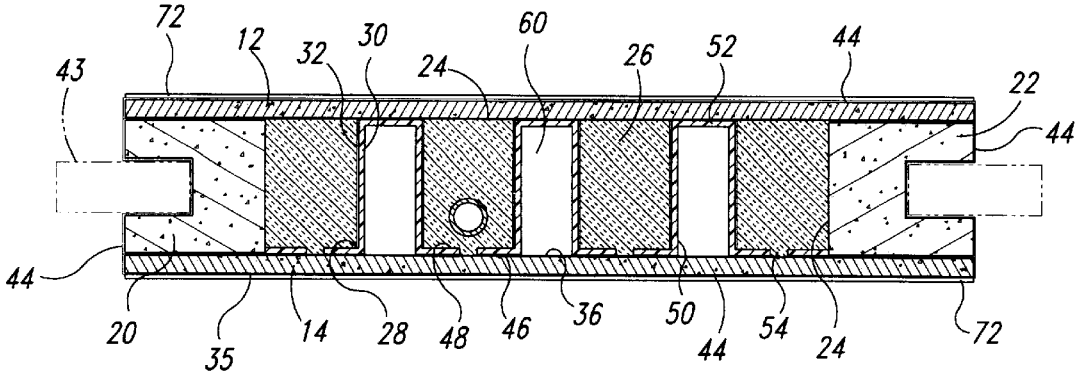
FIG. 3 is an enlarged cross-sectional view taken substantially along line 3—3 of FIG. 2 showing the shear resistance connector array in the interior area of the building panel.
Figure 4:
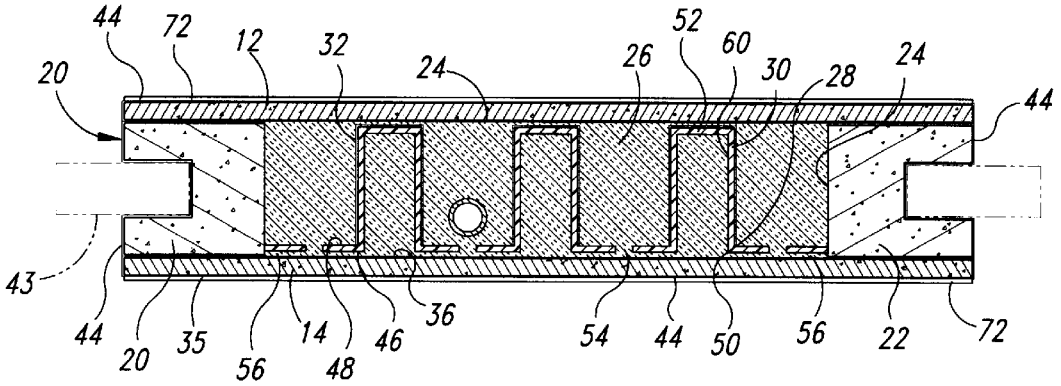
FIG. 4 is a cross-sectional view similar to FIG. 3 illustrating an alternate embodiment of the present invention with an inside area of the shear resistance connectors being shown filled with an insulative core material.

In one embodiment, the front and back face sheets 12 and 14 are impregnated with a polymer to provide a smooth, bondable outer surface 35. A selected covering material 72, as best seen in FIGS. 3 and 4, is attached to one or both of the front and back face sheets 12 and 14 and bonded to the bondable outer surface 35 to provide an aesthetically pleasing cover on the building panel 10. Examples of the covering materials include vinyl, paint, wallpaper, laminate coverings or the like.

In another alternate embodiment, the front and back face sheets 12 and 14 are constructed of a cured slurry mix of a lightweight mineral compound, such as a cement composition. The cement composition is created from cellular cement and a sufficient amount of high silica material to substantially improve the thermal and acoustical insulating and fire-resistant properties of the composition while not detracting materially from its strength. The cement composition includes a plurality of fluid pockets having substantially the same size and shape, wherein the fluid in the pockets is less dense than the cement used in the composition. The fluid pockets reduce the overall density and weight of the cement composition, and the insulating and fire-resistant properties of the cement composition are enhanced. Other compounds that could be used to form the front and back face sheets 12 and 14 include, for example, aerated cement-based compounds, magnesium-based compounds, non-cement base compounds, or other suitable material that demonstrates a high strength-to-weight ratio.

The front and back face sheets 12 and 14 of the first illustrative embodiment have a density in the range of 20 to 150 lbs. per cubic foot, and a minimum insulative value of 0.5 R per inch. Although components of the first embodiment are within the density range and above the minimum insulation value, the density or insulative values can deviate from the preferred values without departing from the spirit and scope of this invention. The preferred composite cellular concrete material is also flame-resistant and is impervious to very high heat, e.g., in excess of 2000 F. Thus, the building panel 10 is fire-resistant, lightweight, and has a high strength-to-weight ratio.

As best seen in FIG. 2, each of the top joining side 16, bottom joining side 18, left joining side 20, and right joining side 22 are elongated members sandwiched between the front and back face sheets 12 and 14. The joining sides 16, 18, 20, and 22 are adhered with a conventional adhesive, such as Dalbert epoxy or the like, to the interior surface 36 of the front and back face sheets 12 and 14 about the perimeter of the face sheets, such that the joining sides define edge portions of the building panel 10. Substantial strength is maintained in the building panel 10, because the front and back face sheets 12 and 14 span between the joining sides 16, 18, 20, and 22 and diaphragmatically brace the building panel. The increased strength of the building panel 10 from the diaphragmatic bracing allows the joining sides 16, 18, 20, and 22 and the face sheets 12 and 14 to be made from the lightweight material while providing a structurally sound building panel.

In the illustrated embodiment, the top, bottom, left, and right joining sides 16, 18, 20, and 22 are molded members constructed of the magnesium oxide-based mineral compound. The joining sides 16, 18, 20, and 22 each have an inner side portion 38 and an opposing outer side portion 40. Each inner side portion 38 faces toward the interior chamber 24 and defines a side of the interior chamber. Each outer side portion 40 faces outwardly away from the interior chamber and is substantially flush with edges of the front and back face sheets 12 and 14. The outer side portion 40 of each joining sides 16, 18, 20, and 22 includes a groove 42 that extends along the length of a respective joining side and connects with grooves of the adjacent joining sides. Accordingly, a substantially continuous groove extends around the perimeter of the building panel 10. In the illustrated embodiment, the groove 42 removably receives a tongue or spline 43 therein, shown in phantom lines in FIGS. 3 and 4, that interconnects two adjacent building panels, for example, during construction of a building or the like.

As best seen in FIGS. 2, 3, and 4, the front and back face sheets 12 and 14, the top and bottom joining sides 16 and 18 (FIG. 2) and the left and right joining sides 20 and 22 include an integral liner 44 made of, as an example, a thin magnesium-based film that reacts exothermically with the magnesium oxide-based slurry material during manufacturing of the face sheets and joining sides. The exothermic reaction is such that the liner 44 securely and rigidly bonds to the outer surface of the respective face sheet 12 or 14 or joining side 16 (FIG. 2), 18 (FIG. 2), 20 and 22. The liner 44 sandwiches the magnesium oxide-based slurry mix therebetween to significantly increase the strength of the front and back face sheets 12 and 14 and the joining sides 16 (FIG. 2), 18 (FIG. 2), 20, and 22 without significantly increasing the weight of the panel.

In an alternate embodiment, a magnesium oxide-based covering material is sprayed onto the exterior surface 35 of the face sheets 12 and 14. The magnesium oxide-based covering reacts exothermically with the magnesium-based film on the face sheets and securely adheres to the face sheets to provide the selected desired exterior panel covering.

The insulative core 26 of the illustrated embodiment is a solid member constructed of cured polyisocyanurate that has a thermal insulative value in the range of 3 R to 9 R per inch. In alternative embodiments, the insulative core 26 is constructed of other modified polyurethane foam, other closed-cell foam material, or other insulative material having a thermal insulative value within the range of 1 R to 9 R per inch. The range of thermal insulative values of the insulating core 26 is a preferred range, although the insulating core can have a thermal insulating value that deviates from the preferred range without departing from the spirit and scope of invention.

As best seen in FIGS. 2–4, the web 34 of the shear resistance connector array 28 in the first embodiment is a generally planar, rectangular-shaped member, and the shear resistance connectors 30 project substantially perpendicularly away from the web. The web 34 has an outer surface 46 that is fixedly connected to the interior surface 36 of the back face sheet 14. An inner surface 48 of the web 34 faces away from the back face sheet 14 toward the front face sheet 12 and is connected to the insulating core 26. Each of the shear resistance connectors 30 is integrally attached at one end to the inner surface 48 of the web 34 and terminates at a free end 52 away from the web. Alternatively, this end can be attached to the other side. The shear resistance connectors 30 are disposed on the web 34 in a selected pattern relative to the front and back face sheets 12 and 14, such as the illustrated pattern of four rows of three shear resistance connectors.

In the first illustrative embodiment, the shear resistance connector array 28 is a unitary sheet of plastic material vacuum formed over a mold so as to define the web 34 and the shear resistance or connectors 30 projecting from the web. The plastic material has a density that is less than the front and back face sheets 12 and 14 and the top, bottom, left, and right joining sides 16, 18, 20, and 22. Accordingly, the shear resistance connector array 28 has a density that is less than the face sheets and joining sides. The illustrated shear resistance connectors 30 are hollow, cylindrical members having an open end 50 adjacent to the web 34 and a closed, free end 52 spaced apart from the web. The web 34 is rigidly connected to the inside surface 36 of the back face sheet 14, the shear resistance connectors 30 project through the plurality of throughholes 32 in the insulating core 26. The closed free ends 52 of the shear resistance connectors 30 are rigidly connected to the interior surface 36 of the front face sheet 12. Although the shear resistant connectors are illustrated in FIG. 2 as being cylindrical members, the shear resistance connectors of alternate embodiments have different geometrical cross-sectional shapes, such as rectangular, square, or polygonal.

The web 34 and the shear resistance connectors 30 effectively keep the front and back face sheets 12 and 14 flat and very stiff so the face sheets distribute wind loads, seismic loads, or other loads over the entire building panel. The flat, stiff stress-skin face sheets 12 and 14 also allow the building panel 10 to be made with a deeper or thinner section while utilizing lightweight and insulative material, such as polyisocyanurate or other modified, closed-cell polyurethane foam, as the insulating core 26 without diminishing the load-bearing capabilities of the building panel.

In one embodiment illustrated in FIG. 3, the web 34 of the shear connecting array 28 is adhered directly to the interior surface 36 of the back face sheet 14, and the closed free ends 52 of the shear resistance connectors 30 are adhered directly to the interior surface 36 of the front face sheet 12. The shear resistance connectors 30 extend through the throughholes 32 in the insulating core 26 and are adhered to the insulating core at the sidewalls that define the throughholes. Accordingly, the shear resistance connectors 30 are rigidly fixed from movement relative to the front and back face sheets 12 and 14 and the insulating core 26.

As best seen in FIG. 4, the web 34 of the first illustrative embodiment has a plurality of apertures 54 spaced about the web between the shear resistance connectors 30. A thin layer 56 of cured polyisocyanurate insulating core material between the outer surface 46 of the web 34 and the interior surface 36 of the back face sheet 14 and through the apertures 54. The thin layer 56 of polyisocyanurate fixedly adheres the web 34 to the interior surface 36 of the back face sheet 14. The thin layer 56 of polyisocyanurate extends through the apertures 54 in the web 34 and is integrally connected to the insulating core 26. Accordingly, the web 34 is fully encased in the cured polyisocyanurate insulation material.

The polyisocyanurate also extends into and fills the hollow inside area 60 of the shear resistance connectors 30. The polyisocyanurate in the shear resistance connectors 30 extends out the shear resistance connector's open end 50 and is integrally connected to the thin layer 56 of polyisocyanurate between the web 34 and the back face sheet 14. Accordingly, the throughholes 32 in the embodiment illustrated in FIG. 4, are completely filled with the shear resistance connectors 30 and the insulative material within the shear resistance connectors. As a result, the building panel 10 has a very high compression strength and shear strength.

In the first illustrated embodiment, each building panel 10 is approximately five feet wide, eight feet tall, and six inches thick. The front and back face sheets 12 and 14 are stress-skin sheets having a thickness of approximately ¼ inch to 1 inch, and the joining sides 16, 18, 20, and 22 are approximately three inches deep. When a plurality of building panels 10 are joined together to form, for example, a panelized wall, the interconnected left and right joining sides 20 and 22 form a six inch by six inch laminated post every five feet of linear wall surface, and the interconnected top and bottom joining sides 16 and 18 form a six inch by six inch laminated beam at every eight vertical feet of wall surface. Accordingly, as the building panels 10 are stacked to accommodate the multistory building structure, the laminated structural support member is formed naturally at each junction between adjacent building panels. The above dimensions are provided for illustrative purposes, and a building panel 10 in accordance with the present invention can have different dimensions and ranges of dimensions without departing from the spirit and scope of the invention.

The building panel 10 of the first illustrated embodiment is constructed by adhering the top, bottom, left, and right joining sides 16, 18, 20, and 22 to the interior surface 36 of the back face sheet 14 about the perimeter of the interior surface such that the joining sides and the back face sheet form a five-sided box structure with an open front side that exposes the interior chamber 24. The five-sided box structure is supported so the open front side faces up. Liquid polyisocyanurate foam is pumped into the interior chamber 24 to form the thin layer 56 of foam that covers the interior surface 36 of the back face sheet 14. As soon as the liquid foam is pumped into the interior chamber 24, closed-cell gas pockets are generated within the foam, and the foam expands in volume.

After the first layer of foam is added, the shear resistance connector array 28 is placed into the interior chamber 24 and the web 34 is set onto the thin layer 56 of foam. The web 34 has approximately the same length and width dimensions as the interior chamber 24 so the web is immediately adjacent to the top, bottom, left, and right joining sides 16, 18, 20, and 22. As a result, all of the shear resistance connectors 30 are placed in a preselected position relative to the joining sides 16, 18, 20, and 22 and proper positioning of the shear resistance connectors within the interior chamber 24 is automatic and takes seconds.

After the shear resistance connector array 28 is initially placed into the interior chamber 24, the shear resistance connector array is pressed toward the back face sheet 14 to a selected position. Some of the expanding foam is displaced as the shear resistance connector array 28 is pressed into place, and the foam extends upwardly through the apertures 54 in the web 34. The foam also expands upwardly through the open end 50 of the shear resistance connectors 30 into the inner area 60. The volume of the displaced and expanding foam is sufficient to fill the inner areas 60 of the shear resistance connectors 30, so as to provide solid cores in the shear resistance connectors after the foam is cured and hardened.

After the shear resistance connector array 28 is in the selected position within the interior chamber 24, additional liquid polyisocyanurate foam is pumped into the interior chamber. The polyisocyanurate foam expands and fills the interior chamber 24 as the gas pockets are formed, and the front face sheet 12 is fixedly secured to the joining sides 16, 18, 20, and 22 to cover the interior chamber 24. The amount of foam pumped into the interior chamber 24 is such that the foam would expand and overflow from the interior chamber if allowed to freely and fully expand. However, the front face sheet 12 is secured in place before the foam fully expands, and the front face sheet blocks the foam from expanding beyond the volume of the interior chamber 24. The foam is a self-bonding foam that bonds to the face sheets and the shear resistance connector array 26.

When the front face sheet 12 is secured in position, the interior surface 36 of the front face sheet is adjacent to the closed free ends 52 of the shear resistance connectors 30 and a thin layer of the polyisocyanurate foam extends between the closed free ends and the front face sheet. The polyisocyanurate foam in the interior chamber 24 completely encases the shear resistance connector array 28 and the foam then cures and hardens to define a strong, lightweight insulative core 26.

Figure 5:
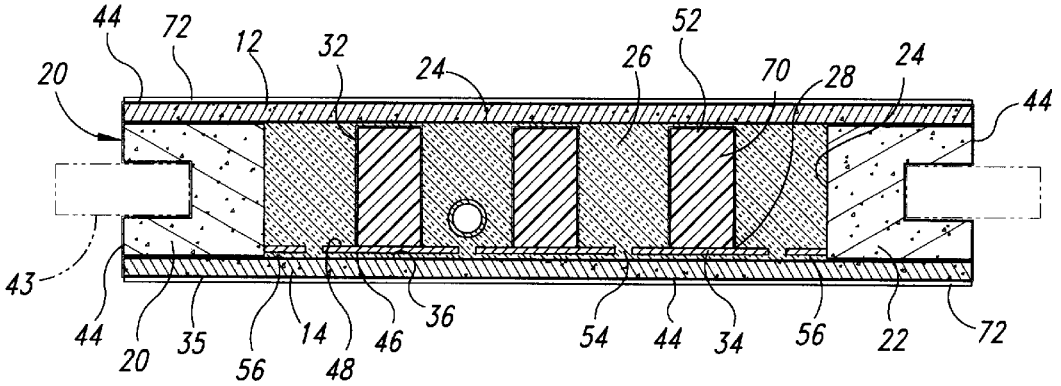
FIG. 5 is a cross-sectional view similar to FIG. 3 showing an alternate embodiment of the present invention wherein the shear resistance connector array includes shear resistance connectors fixedly adhered to a web of the shear resistance connector array.

As best seen in FIG. 5, an alternate embodiment includes a shear resistance connector array 28 having a web 34 that is a substantially rectangular sheet of plastic material, and the sheer connectors 70 are solid members fixedly adhered to the inner surface 48 of the web in a predetermined pattern during an array manufacturing process. The solid shear resistance connectors 70 and the web 34 are moved as a unit and placed into the interior chamber 24 of the building panel 10 during assembly of the building panel. In yet another embodiment of the invention, the shear resistance connector array 28 is placed into the interior chamber 24 and the web 34 is adhered directly to the interior surface 36 of the back face sheet 14. Thereafter, the insulating core 26 is placed in the interior chamber 24 and the insulating core surrounds and encases the shear resistance connectors 30. The front face sheet 12 is then adhered to the joining sides 16, 18, 20, and 22 to cover the interior area 24 and to close out the building panel 10.

Figure 6:
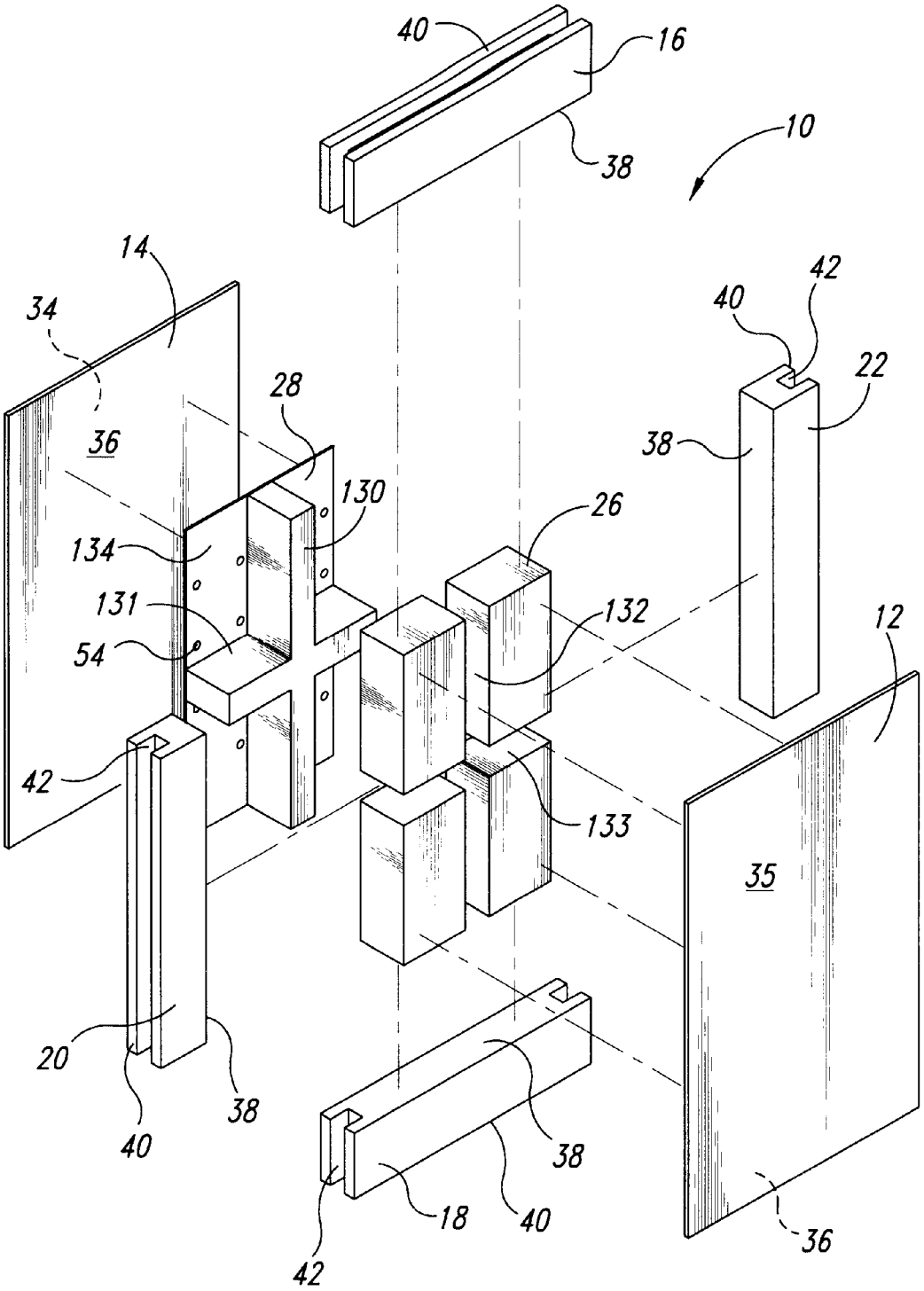
FIG. 6 is a reduced, schematic exploded view of an alternate embodiment of the building panel in accordance with the present invention.

As best seen in FIG. 6, another alternate embodiment of the present invention includes a shear resistance connector array 28 having a web 134 attached to a first elongated shear resistance connector 130 that extends between the top and bottom joining sides 16 and 18. The web 134 is also attached to a second elongated shear resistance connector 131 that extends between the left and right joining sides 20 and 22 transverse to the first elongated shear resistance connector 130 such that the first and second shear resistance connectors define a substantially cross-shaped pair of shear resistance connectors. Each of the first and second elongated shear resistance connectors is formed by a channel having a depth that substantially corresponds to the depth of the insulating core 26.

The insulating core 26 of this alternate embodiment has elongated throughholes 132 and 133 that receive the first and second shear resistance connectors 130 and 131, respectively. Accordingly, the first shear resistance connector 130 forms a post-like structure extending along its respective throughhole 132 within the panel 10 and the second shear resistance connector 131 forms a beam-like structure extending along its respective throughhole 133.

In another alternate embodiment, the throughholes 132 and 133 extend diagonally through the insulating core 26 and the first and second shear resistance connectors 130 and 131 extend diagonally through the interior chamber 24 of the panel 10. Accordingly, the first and second shear resistance connectors 130 and 131 form an X-shaped pair of shear resistance connectors within the panel. In other alternate embodiments not shown, the shear resistance connector array 28 has a single elongated shear resistance connector extending through the interior chamber vertically, horizontally, or diagonally between the top and bottom joining sides 16 and 18 on the left and right joining sides 20 and 22, and the insulating core 26 has a corresponding throughhole that receives the shear resistance connectors.

In an alternate method of making the building panel 10, the back face sheet 14 and the joining sides 16, 18, 20, and 22 are fixedly adhered together. The web 34 of the shear resistance connector array 28 is adhered to the interior surface 36 of the back face sheet 14, such that the shear resistance connectors 30 extend across the interior chamber 24 of the building panel. Thereafter, the front face sheet 12 is adhered to the joining sides 16, 18, 20, and 22 and also adhered to the closed free ends 52 of the shear resistance connectors 30. Then, a predetermined amount of the polyisocyanurate foam or other modified polyurethane foam is injected into the interior chamber 24 through at least one injection hole. After a predetermined amount of foam is added, the injection hole is then plugged to prevent the foam from expanding and flowing out of the interior chamber 24.

These manufacturing processes of pumping the expanding liquid foam into the interior chamber 24 can result in substantial pressure being exerted on the front and back face sheets 12 and 14 and the joining sides 16, 18, 20, and 22 as the foam attempts to fully expand. After the foam has solidified, however, the pressure from the foam expansion ceases. Accordingly, if an insulating core 26 having a higher density is desired, a greater amount of foam is pumped into the interior chamber 24, and the front and back face sheets 12 and 14 and the joining sides 16, 18, 20, and 22 are structurally supported by a jig or the like that protects the panel from expanding and separating. Accordingly, the density, weight, insulative value, and compressive strength of the insulating core 26 and thus, the building panel 10, is easily controlled by increasing or decreasing the amount and type of foam pumped into the interior chamber 24.

In addition to controlling the properties of the building panel 10 by varying the density of the insulating core 26, the thickness of the face sheets 12 and 14 and the joining sides 16, 18, 20, and 22 is also controlled to maintain sufficient strength while minimizing the weight of the building panel. In addition, the properties of the building panel are controlled by the number and pattern of shear resistance connectors 30 on the shear resistance connector array 28. Accordingly, a building panel 10 of the present invention can be easily manufactured to have a preselected compressive strength, shear strength, tensile strength, flexural strength, weight, insulative value, and acoustical characteristics.

Figure 7:
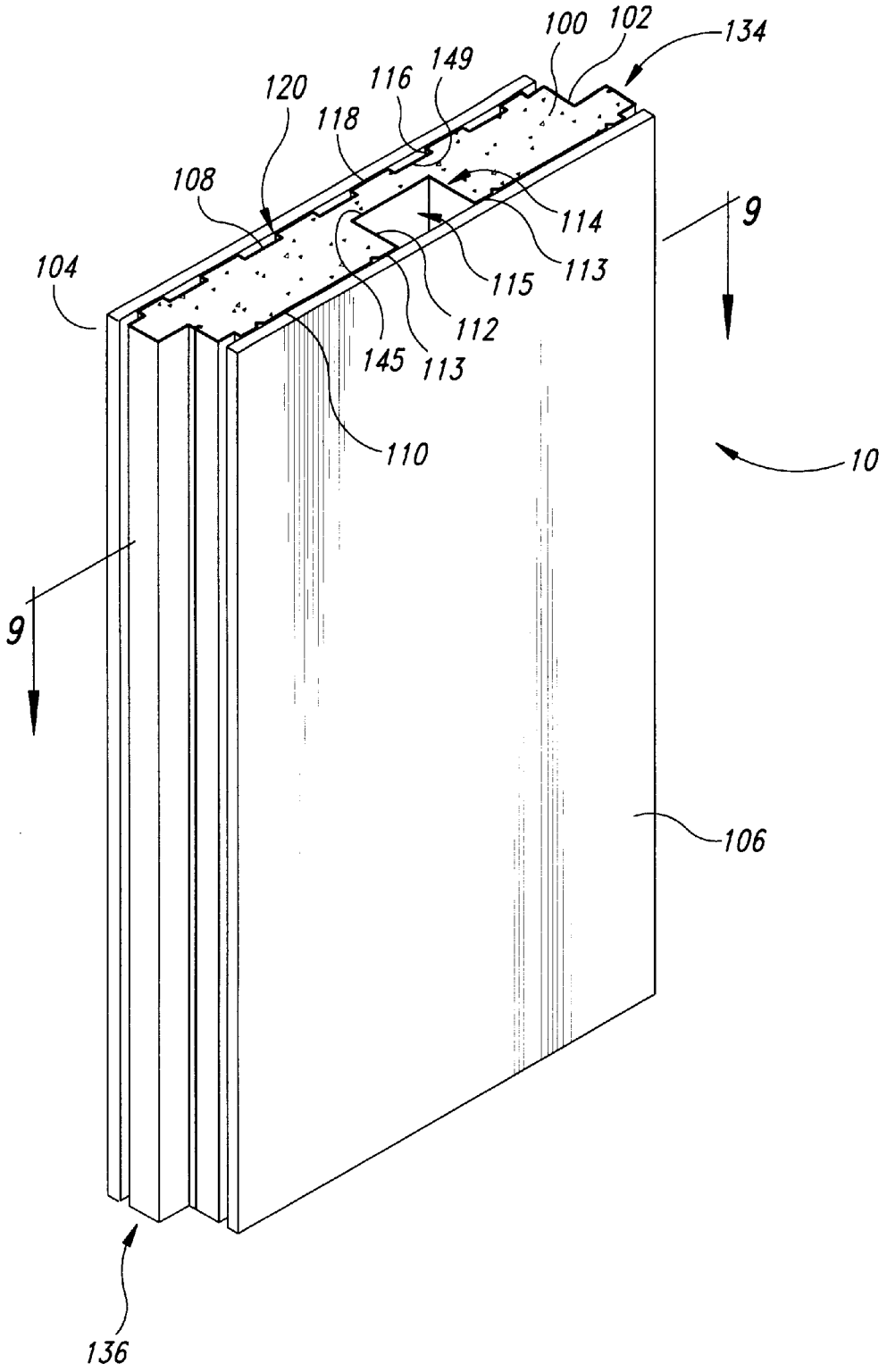
FIG. 7 is an isometric view of a building panel in accordance with an alternate embodiment of the present invention.
Figure 8:
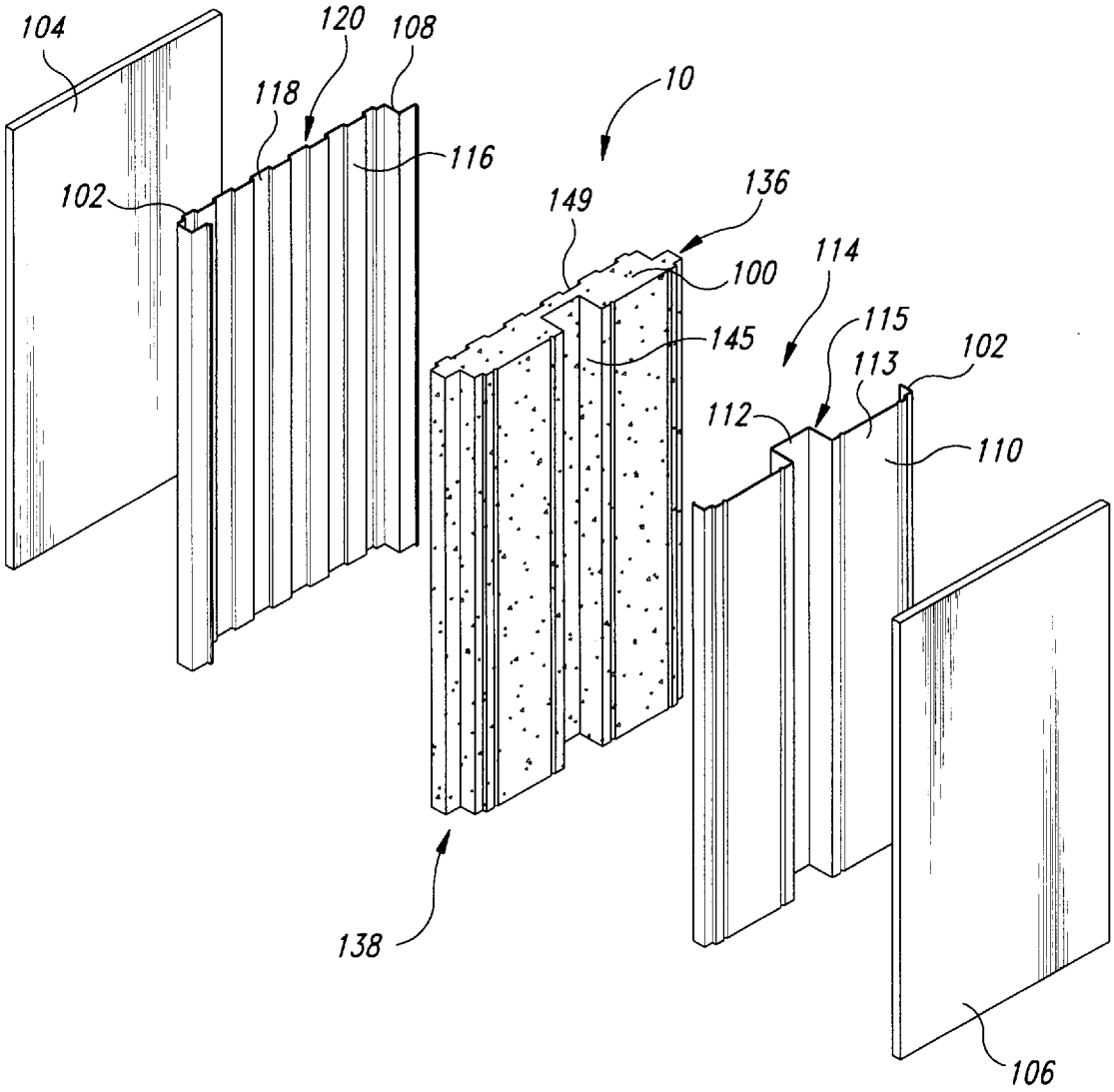
FIG. 8 is a reduced, schematic exploded isometric view of the building panel of FIG. 7.
Figure 9:
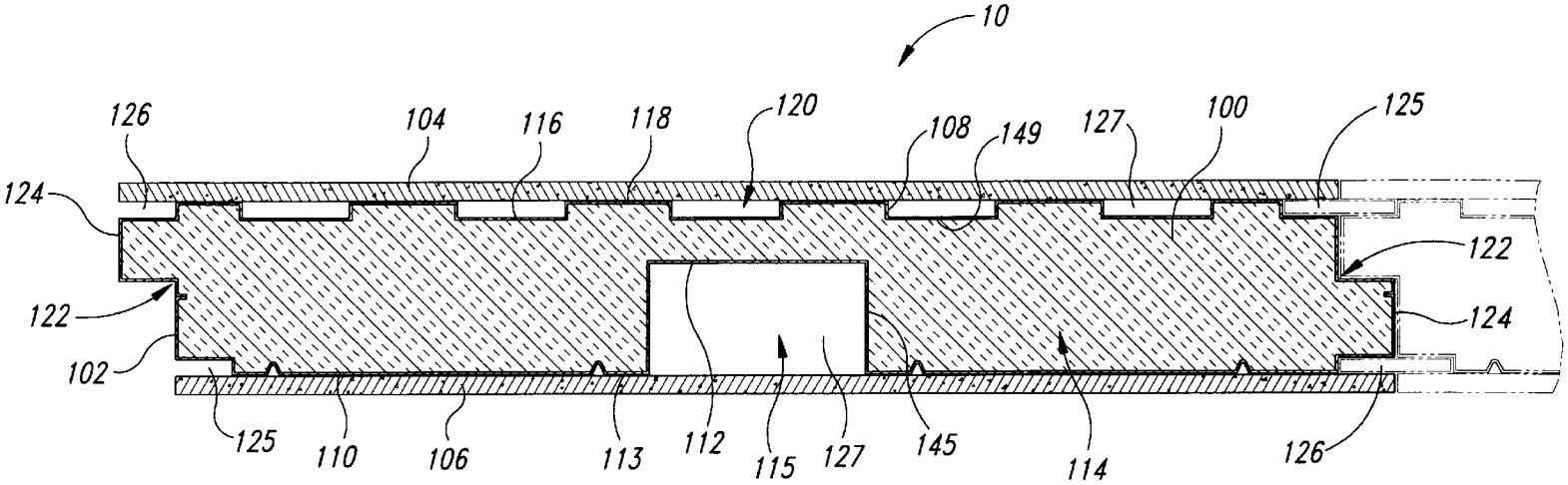
FIG. 9 is an enlarged cross-sectional view taken substantially along line 9—9 of FIG. 7 showing an adjacent panel in phantom lines.

As best seen in FIGS. 7–9, another alternate embodiment of the present invention includes a building panel 10 having the insulative core 100 contained within an outer skin 102. Front and back face sheets 104 and 106 are connected to opposing sides of the outer skin 102 to form the front and back sides of the building panel 10. The outer skin 102 is formed by front and back sections 108 and 110 that are connected together to define an interior area 114, which is filled by the insulative core 100. The front and back sections 108 and 110 in the illustrated embodiment are each constructed of a thin metal film, such as 30 gauge roll-formed metal that is contoured into the front or back section's final shape before being connected with the other section during the manufacturing of the building panel 10. The outer skin 102 in alternate embodiments are constructed of plastic, ceramic, and cementous materials.

The outer film's back section 10 has an elongated shear resistance connector 112 integrally formed therein. The shear resistance connector 112 defines a channel that extends between the top and bottom ends of the building panel 10. The shear resistance connector 112 is connected to a portion of the outer film's back section 110 that defines a web portion 113, so a shear resistance connector array 115 is integrally connected to the back section.

The shear resistance connector 112 extends away from the web portion 113 toward the outer skin's front section 108 and terminates at a position within the interior area 114 between the front and back sections 108 and 110. The shear resistance connector 112 is positioned in an aperture 145 defining a throughhole that extends partially through the insulative core 100. In the illustrated embodiment, the shear resistance connector 112 and the aperture 145 extend approximately 62% of the way across the interior area, and the shear resistance connector does not contact or engage the outer film's front section 108.

In alternate embodiments, the shear connector 112 and aperture 145 extend across the interior area 114 within the range of approximately 35% to 100%, inclusive, of the distance between the front and back sections 108 and 110. The shear resistance connector 112 is securely and rigidly bonded to the portion of the insulative core 100 that defines the aperture 145, such that the connection along the surface of the shear resistance connector adds a significant amount of strength to the building panel 10 without a significant weight increase.

The outer skin's front section 108 has a plurality of elongated shear resistance connectors 116 integrally formed therein that extend between the top and bottom edges of the building panel 10. Each of the shear resistance connectors 116 is spaced-apart from adjacent shear resistance connectors by a portion of the front section that define a web portion 118. Accordingly, the shear resistance connectors 116 and the web portions 118 are integrally formed in the outer skin's front section 108 and are integrally connected together to define a shear resistance connector array 120.

The shear resistance connectors 116 extend away from the web portions 118 into the interior area 114 and terminate at a position spaced apart from the outer skin's back section 110. Each of the shear resistance connectors 116 extend into apertures 149 that extend partially through the insulative core 100. The distance the shear resistance connectors 116 and apertures 149 extend into the interior area 114 is in the range of approximately 10%–30%, inclusive, of the distance between the front and back sections 108 and 110. The shear resistance connectors 116 engages and are securely and rigidly bonded to the portions of the insulative core 100 defining the apertures 149 so as to increase the strength of the building panel without a significant weight increase.

The size and configuration of the shear resistance connectors 116 of the outer skin's front section 108, and the size and configuration of the shear resistance connector 112 of the outer skin's back section 110 are different for building panels 10 having different structural requirements. The sizes and configurations of the shear resistance connectors 112 and 116 are selected during the design of a building panel 10 to provide the desired compressive strength, shear strength, tensile strength, flexural strength, weight, insulative value, and acoustical characteristics selected for the particular building panel.

In alternate embodiments, the shear resistance connector array 120 of the back section 110 has the shear resistance connector 112 with different shapes, such as an arcuate shape or a V-shape channel. In another embodiment, the shear resistance connectors 116 of the outer skin's front section 108 are defined by a plurality of cylindrical-shaped shear resistance connectors, such as those shown in FIG. 2, that are spaced apart from each other and integrally connected to the web portion 120.

As best seen in FIG. 9, the outer film's front and back sections 108 and 110 are formed with integral joinery portions 122 on left and right sides of the building panel 10 that are adapted to mate with joinery portions of adjacent building panels when building panels are interconnected in a side-by-side relationship. The joinery portion 122 has a step configuration with a tongue portion 124 extending outwardly away from the interior area 114. The tongue portion 124 is shaped and sized to be positioned adjacent to the tongue portion of an adjacent building panel, shown in phantom lines in FIG. 9. The tongue portion 124 of each joinery portion 122 has a first recess 125 formed therein and a similar second recess 126 is formed adjacent to the joinery portion 122 opposite the first recess. When the joinery portions 122 of the two building panels 10 are joined together in a side-by-side relationship, the recesses 125 and 126 are adjacent to each other and receive a spline therein (shown in phantom lines) that is used to interconnect the building panels. Although the joinery portions 122 illustrated in FIG. 9 has a single tongue configuration, other joinery configurations are used in alternate embodiments.

The front and back face sheets 104 and 106 are adhered to the respective front and back sections 108 and 110 of the outer skin 102. In the embodiment illustrated in FIG. 9, the front and back face sheets 104 and 106 are connected directly to the outer skin with the inside area 127 defined by the shear resistance connectors 112 and 116 are closed and unfilled.

Figure 10:
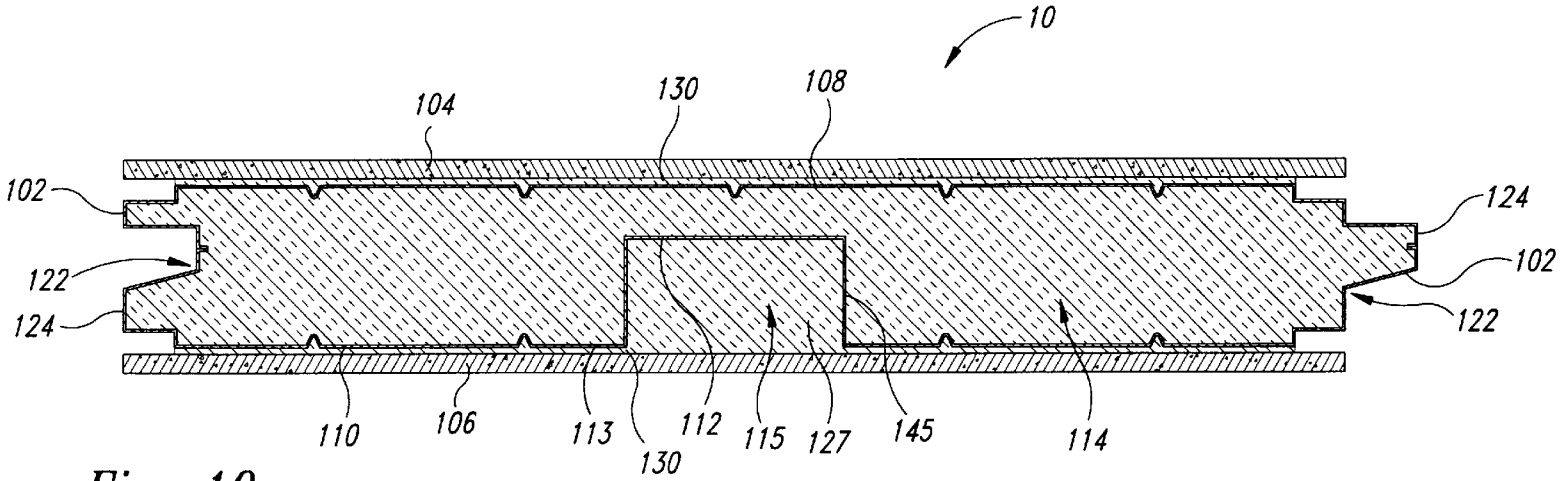
FIG. 10 is a cross-sectional view similar to FIG. 9 with shear resistance connectors being filled with a selected material.

In an alternate embodiment of the invention shown in FIG. 10, the building panel 10 has the shear resistance connector array 115 with the single channel-shaped shear resistance connector 112, and the outer skin's front section 108 does not include a shear resistance connector array. The building panel 10 has an adhesive layer 130 positioned between the outer skin's front section 108 and the front face sheet 104 and between the outer skin's back section 110 and the back face sheet 106. In the illustrated embodiment, the adhesive layer 130 is formed of the same foam material as the insulative core 100, such as the polyisocyanurate or other closed-cell urethane foam. The adhesive layers 130 extend into the inside area 127 in the shear resistance connector 112 and filly fill the shear resistance connectors. Accordingly, the shear connector array 115 is fully encased and rigidly connected to material on all sides, which results in a building panel 10 having an increased strength without a substantial weight increase.

In the alternate embodiments of FIGS. 7–10, each building panel 10 is approximately two feet wide, eight feet tall, and four inches thick. These dimensions are provided for illustrative purposes, and a building panel 10 in accordance with the present invention can have different dimensions and ranges of dimensions without departing from the spirit and scope of the invention.

As best seen in FIGS. 7 and 8, the top and bottom portions 134 and 136 are open such that the insulative core 100 is exposed. This illustrated building panel 10 is adapted to fit within conventional top and bottom channels that are attached to a floor or ceiling of a building structure, such that the channels cap the top and bottom ends of building panels. In an alternate embodiment, not illustrated, the top and bottom portions 134 and 136 are fully closed without the use of the channels, such that the insulative core 100 is not exposed. In yet another alternate embodiment, the outer skin 102 is formed such that joinery portions are provided along the top and bottom portions 134 and 136 of the building panel 10. Accordingly, as the building panels 10 are connected together during construction of a multi-story building structure, the joinery portions along the top, bottom, left and right sides of each building panel form a junction between adjacent building panels.

When building panels 10 of the alternate embodiments of FIGS. 9 and 10 are manufactured, the outer skin's front and back sections 108 and 110 are fabricated with the shear resistance connector arrays 120 and 115, respectively, therein. A first one of the front and back sections 108 and 110 is placed in a fixture so as to provide a pan-like structure, and the polyisocyanurate or other closed-cell foam is pumped into the pan-like structure in a liquid form. The foam then begins to expand and the other of the front and back sections 108 and 110 is placed into the fixture on top of and secured to the first section to define the interior area 114. The foam then expands and completely fills the interior area 114. The foam or other insulative material forming the insulative core 100 is a self-bonding material that securely bonds itself to the outer skins front and back sections 108 and 110.

The front and back sections 108 and 110 are rigidly held in position by the fixture such that the expansion of the polyisocyanurate foam does not force the front and back sections apart during the manufacturing process. After the foam solidifies to form the insulative core 100, the insulative core and the outer skin 102 are permanently and securely bonded together by the polyisocyanurate to form a middle portion of the building panel 10. Accordingly, the shear resistance connectors arrays 115 and 120 are integrally formed in the middle portion of the building panel 10. In one embodiment there are thermal breaks 140 (shown in phantom lines) provided between the outer skins front and back sections 108 and 110 to reduce or prevent thermal bonding between the front and back sections.

The front and back face sheets 104 and 106 may then be adhered to the outer skin 102. In one embodiment, the front and back face sheets 104 and 106 are adhered to the outer skin with conventional fasteners. In the embodiment illustrated in FIG. 10, the front and back face sheets 104 and 106 are adhered to the outer skin 102 by the polyisocyanurate adhesive layer 130. The bond provided between the polyisocyanurate, the outer skin 102 and the front or back face sheets 104 and 106 has a sufficient strength to ensure the strength requirements of the panel 10 are met.

In an alternate embodiment, only one of the front or back face sheets 104 and 106 is adhered to the outer skin 102 before the building panel 10 is shipped to a construction site. The building panels 10 with the single face sheet are joined together at the construction site, and the other of the front or back face sheets 104 and 106, is then added to the building panel. The face sheet added at the construction site in accordance with the specification of the construction project can be added to the building panels in an efficient and timely manner, thereby resulting in a completed building that utilizes the beneficial characteristics of the building panel 10.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A structural building component comprising:

a skin portion having first and second sections interconnected to define an interior area;

an insulating core contained in the interior area for improving the insulating properties of the structural building component, the insulating core having a first side adjacent to the first section and a second side adjacent to the back section, the insulating core having an aperture therein extending at least partially between the first and second sides;

a shear resistance connector array connected to the first section of the skin portion, the shear resistance connector array having a web and a shear resistance connector connected to the web and projecting away from the web, the web being connected to the first side of the insulating core and the shear resistance connector engaging the insulating core and projecting into the aperture in the insulating core;

a face sheet connected to a selected one of the first and second sections of the skin portion; and wherein a portion of the insulating core is positioned in the shear resistance connector with the portion of the insulating core and the shear resistance connector substantially filling the aperture.

2. The structural building component of claim 1 wherein the insulating core has a plurality of apertures therein extending at least partially between the first and second sides, and the shear resistance connector array has a plurality of shear resistance connectors connected to the web and projecting away from the web into the plurality of apertures.

3. The structural building component of claim 1 wherein the shear resistance connector is a substantially hollow member having an open first end adjacent to the first side of the insulating core and a second end intermediate the first and second sides of the insulating core.

4. The structural building component of claim 1 wherein the shear resistance connector array is a first shear connector array, and further comprising a second shear resistance connector array connected to the second section of the skin portion, the second shear resistance connector array having a second web portion and a second shear resistance connector connected to the second web and extending toward the first side portion.

5. The structural building component of claim 4 wherein the second shear resistance connector array is integrally connected to the second section of the skin portion.

6. The structural building component of claim 1 wherein the skin portion is a layer of metal material surrounding the insulative core.

7. The structural building component of claim 1 wherein the insulation's core is self-bonding material that is bonded to the skin portion.

8. A structural building component comprising:

first and second outer skin portions connected together to define an interior area therebetween;

an insulative core in the interior area, the insulative core having opposing first and second sides and a plurality of apertures extending at least partially between the first and second sides, the first side of the insulative core being substantially adjacent to the first outer skin portion, and the second side of the insulative core being substantially adjacent to the second outer skin portion;

a first unitary shear resistance connector array having a first web and a first shear resistance connector connected to the first web and projecting away from the first web, the unitary first shear resistance connector being integral to the first outer skin portion, and the first shear resistance connector being in one of the apertures;

a second unitary shear resistance connector array having a second web and a plurality of second shear resistance connectors connected to the second web and projecting away from the second web, the unitary second shear resistance connector array being integral to the second outer skin portion, and each of the second shear resistance connectors being in a selected one of the apertures;

wherein the first and second shear resistance connectors are substantially hollow members with an inside area and each of the inside areas is filled with a selected material; and a face sheet connected to one of the first and second outer skin portions.

9. The structural building component of claim 8 wherein the insulating core is made of the selected material.

10. The structural building component of claim 8 wherein the first shear resistance connector is an elongated channel portion extending between opposing end portions of the first outer skin portion.

11. The structural building component of claim 8 wherein the second shear resistance connectors are elongated channel portions extending between opposing end portions of the second outer portion.

12. The structural building component of claim 11 wherein the first shear resistance connector is an elongated channel portion extending between opposing end portions of the first outer skin portion.

* * * * *